US005953918A

United States Patent [19]

Kalina et al.

[11] Patent Number: 5,953,918

[45] Date of Patent: Sep. 21, 1999

[54] METHOD AND APPARATUS OF CONVERTING HEAT TO USEFUL ENERGY

[75] Inventors: Alexander I. Kalina, Hillsborough; Richard I. Pelletier; Lawrence B. Rhodes, both of Livermore, all of Calif.

[73] Assignee: Exergy, Inc., Hagward, Calif.

[21] Appl. No.: 09/019,476

[22] Filed: Feb. 5, 1998

[51] Int. Cl.[6] ..... F01K 7/34

[52] U.S. Cl. ..... 60/653; 60/676; 60/679

[58] Field of Search ..... 60/645, 653, 670, 60/676, 679

[56] References Cited

U.S. PATENT DOCUMENTS

| | | | |
|---|---|---|---|
| 4,346,561 | 8/1982 | Kalina . | |
| 4,489,563 | 12/1984 | Kalina . | |
| 4,548,043 | 10/1985 | Kalina . | |
| 4,586,340 | 5/1986 | Kalina . | |
| 4,604,867 | 8/1986 | Kalina . | |
| 4,674,285 | 6/1987 | Durrant et al. | 60/676 |
| 4,732,005 | 3/1988 | Kalina . | |
| 4,763,480 | 8/1988 | Kalina . | |
| 4,899,545 | 2/1990 | Kalina . | |
| 4,982,568 | 1/1991 | Kalina . | |
| 5,029,444 | 7/1991 | Kalina . | |
| 5,095,708 | 3/1992 | Kalina . | |
| 5,440,882 | 8/1995 | Kalina . | |
| 5,450,821 | 9/1995 | Kalina . | |
| 5,572,871 | 11/1996 | Kalina . | |
| 5,588,298 | 12/1996 | Kalina et al. . | |
| 5,603,218 | 2/1997 | Hooper | 60/676 X |
| 5,649,426 | 7/1997 | Kalina et al. . | |

FOREIGN PATENT DOCUMENTS 7-94815 10/1995 Japan .

OTHER PUBLICATIONS

NEDO Brochure, "ECO–Energy City Project", 1994.

NEDO Report published 1996, pp. 4–6, 4–7, 4–43, 4–63, 4–53.

*Primary Examiner*—Hoang Nguyen

*Attorney, Agent, or Firm*—Alan H. Gordon & Associates, P.C.

[57] ABSTRACT

A method and apparatus for implementing a thermodynamic cycle. A heated gaseous working stream including a low boiling point component and a higher boiling point component is separated, and the low boiling point component is expanded to transform the energy of the stream into useable form and to provide an expanded relatively rich stream. This expanded rich stream is then split into two streams, one of which is expanded further to obtain further energy, resulting in a spent stream, the other of which is extracted. The lean unexpanded stream and the spent rich stream are then combined in a regenerating subsystem with the extracted stream to reproduce the working stream, which is then efficiently heated in a heater to provide the heated gaseous working stream that is separated.

18 Claims, 4 Drawing Sheets

METHOD AND APPARATUS OF CONVERTING HEAT TO USEFUL ENERGY

BACKGROUND OF THE INVENTION

The invention relates to implementing a thermodynamic cycle to convert heat to useful form.

Thermal energy can be usefully converted into mechanical and then electrical form. Methods of converting the thermal energy of low temperature heat sources into electric power present an important area of energy generation. There is a need for increasing the efficiency of the conversion of such low temperature heat to electric power.

Thermal energy from a heat source can be transformed into mechanical and then electrical form using a working fluid that is expanded and regenerated in a closed system operating on a thermodynamic cycle. The working fluid can include components of different boiling temperatures, and the composition of the working fluid can be modified at different places within the system to improve the efficiency of operation. Systems that convert low temperature heat into electric power are described in Alexander I. Kalina's U.S. Pat. Nos. 4,346,561; 4,489,563; 4,982,568; and 5,029,444. In addition, systems with multicomponent working fluids are described in Alexander I. Kalina's U.S. Pat. Nos. 4,548,043; 4,586,340, 4,604,867; 4,732,005; 4,763,480, 4,899,545; 5,095,708; 5,440,882; 5,572,871 and 5,649,426, which are hereby incorporated by reference.

SUMMARY OF THE INVENTION

The invention features, in general a method and system for implementing a thermodynamic cycle. A working stream including a low boiling point component and a higher boiling point component is heated with a source of external heat (e.g., a low temperature source) to provide a heated gaseous working stream. The heated gaseous working stream is separated at a first separator to provide a heated gaseous rich stream having relatively more of the low boiling point component and a lean stream having relatively less of the low boiling point component. The heated gaseous rich stream is expanded to transform the energy of the stream into useable form and to provide an expanded, spent rich stream. The lean stream and the expanded, spent rich stream are then combined to provide the working stream.

Particular embodiments of the invention may include one or more of the following features. The working stream is condensed by transferring heat to a low temperature source at a first heat exchanger and thereafter pumped to a higher pressure. The expanding takes place in a first expansion stage and a second expansion stage, and a stream of partially expanded fluid is extracted between the stages and combined with the lean stream. A separator between the expander stages separates a partially expanded fluid into vapor and liquid portions, and some or all of the vapor portion is fed to the second stage, and some of the vapor portion can be combined with the liquid portion and then combined with the lean stream. A second heat exchanger recuperatively transfers heat from the reconstituted multicomponent working stream (prior to condensing) to the condensed multicomponent working stream at a higher pressure. A third heat exchanger transfers heat from the lean stream to the working stream after the second heat exchanger. The working stream is split into two substreams, one of which is heated with the external heat, the other of which is heated at a fourth heat exchanger with heat from the lean stream; the two streams are then combined to provide the heated gaseous working stream that is separated at the separator.

Embodiments of the invention may include one or more of the following advantages. Embodiments of the invention can achieve efficiency of conversion of low temperature heat to electric power that exceeds the efficiency of standard Rankine cycles.

Other advantages and features of the invention will be apparent from the following detailed description of particular embodiments and from the claims.

DETAILED DESCRIPTION OF THE INVENTION

Figure 1:
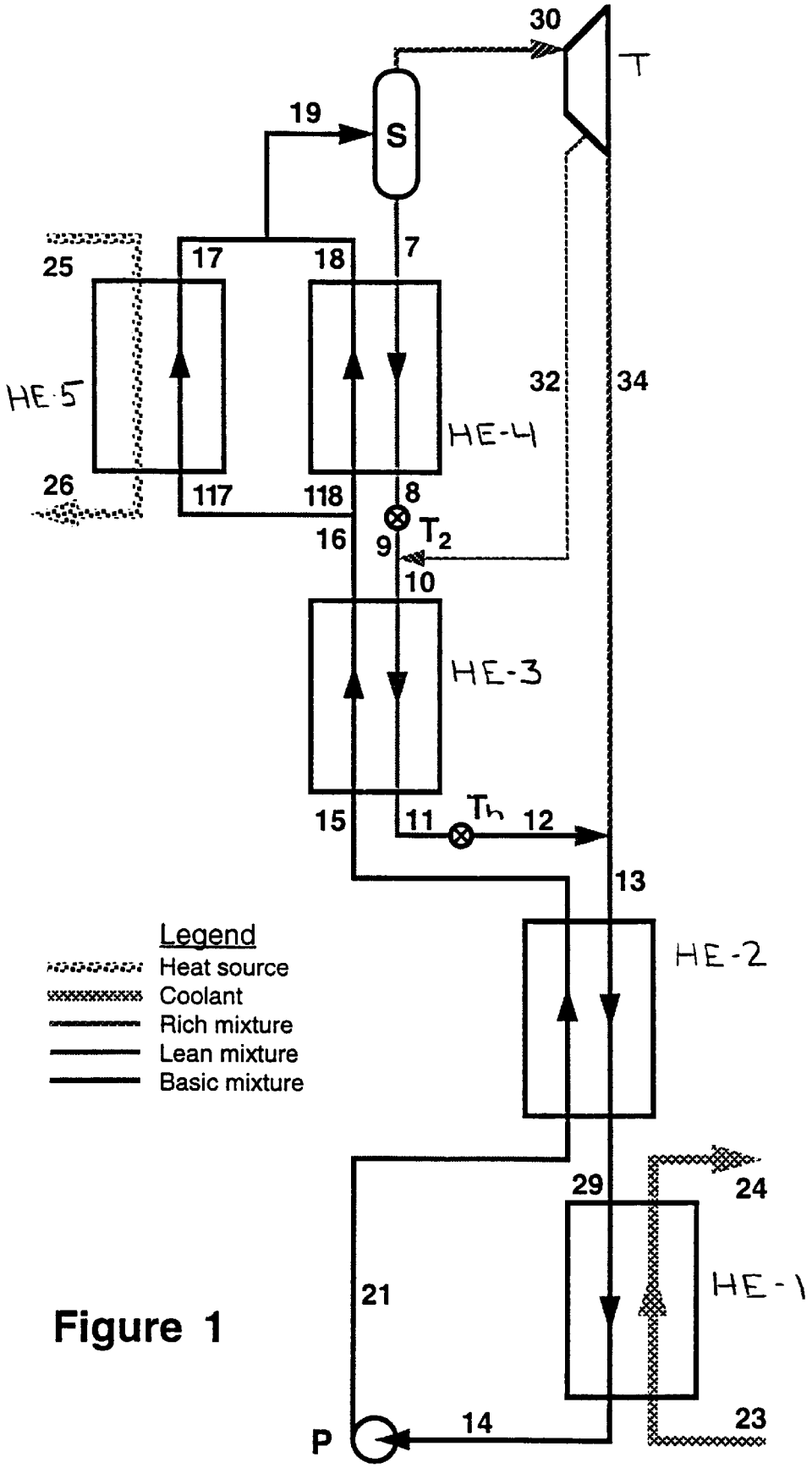
FIG. 1 is a diagram of a thermodynamic system for converting heat from a low temperature source to useful form.

Referring to FIG. 1, a system for implementing a thermodynamic cycle to obtain useful energy (e.g., mechanical and then electrical energy) from an external heat source is shown. In the described example, the external heat source is a stream of low temperature waste-heat water that flows in the path represented by points 25–26 through heat exchanger HE-5 and heats working stream 117-17 of the closed thermodynamic cycle. Table 1 presents the conditions at the numbered points indicated on FIG. 1. A typical output from the system is presented in Table 5.

The working stream of the FIG. 1 system is a multicomponent working stream that includes a low boiling component and a high boiling component. Such a preferred working stream may be an ammonia-water mixture, two or more hydrocarbons, two or more freons, mixtures of hydrocarbons and freons, or the like. In general, the working stream may be mixtures of any number of compounds with favorable thermodynamic characteristics and solubility. In a particularly preferred embodiment, a mixture of water and ammonia is used. In the system shown in FIG. 1, the working stream has the same composition from point 13 to point 19.

Beginning the discussion of the FIG. 1 system at the exit of turbine T, the stream at point 34 is referred to as the expanded, spent rich stream. This stream is considered "rich" in lower boiling point component. It is at a low pressure and will be mixed with a leaner, absorbing stream having parameters as at point 12 to produce the working stream of intermediate composition having parameters as at point 13. The stream at point 12 is considered "lean" in lower boiling point component.

At any given temperature, the working stream (of intermediate composition) at point 13 can be condensed at a lower pressure than the richer stream at point 34. This permits more power to be extracted from the turbine T, and increases the efficiency of the process.

The working stream at point 13 is partially condensed. This stream enters heat exchanger HE-2, where it is cooled and exits the heat exchanger HE-2 having parameters as at point 29. It is still partially, not completely, condensed. The stream now enters heat exchanger HE-1 where it is cooled by stream 23-24 of cooling water, and is thereby completely condensed, obtaining parameters as at point 14. The working stream having parameters as at point 14 is then pumped to a higher pressure obtaining parameters as at point 21. The working stream at point 21 then enters heat exchanger HE-2 where it is recuperatively heated by the working stream at points 13–29 (see above) to a point having parameters as at point 15. The working stream having parameters as at point 15 enters heat exchanger HE-3 where it is heated and obtains parameters as at point 16. In a typical design, point 16 may be precisely at the boiling point but it need not be. The working stream at point 16 is split into two substreams; first working substream 117 and second working substream 118. The first working substream having parameters as at point 117 is sent into heat exchanger HE-5, leaving with parameters as at point 17. It is heated by the external heat source, stream 25-26. The other substream, second working substream 118, enters heat exchanger HE-4 in which it is heated recuperatively, obtaining parameters as at point 18. The two working substreams, 17 and 18, which have exited heat exchangers HE-4 and HE-5, are combined to form a heated, gaseous working stream having parameters as at point 19. This stream is in a state of partial, or possibly complete, vaporization. In the preferred embodiment, point 19 is only partially vaporized. The working stream at point 19 has the same intermediate composition which was produced at point 13, completely condensed at point 14, pumped to a high pressure at point 21, and preheated to point 15 and to point 16. It enters the separator S. There, it is separated into a rich saturated vapor, termed the "heated gaseous rich stream" and having parameters as at point 30, and a lean saturated liquid, termed the "lean stream" and having parameters as at point 7. The lean stream (saturated liquid) at point 7 enters heat exchanger HE-4 where it is cooled while heating working stream 118-18 (see above). The lean stream at point 9 exits heat exchanger HE-4 having parameters as at point 8. It is throttled to a suitably chosen pressure, obtaining parameters as at point 9.

Returning now to point 30, the heated gaseous rich stream (saturated vapor) exits separator S. This stream enters turbine T where it is expanded to lower pressures, providing useful mechanical energy to turbine T used to generate electricity. A partially expanded stream having parameters as at point 32 is extracted from the turbine T at an intermediate pressure (approximately the pressure as at point 9) and this extracted stream 32 (also referred to as a "second portion" of a partially expanded rich stream, the "first portion" being expanded further) is mixed with the lean stream at point 9 to produce a combined stream having parameters as at point 10. The lean stream having parameters as at point 9 serves as an absorbing stream for the extracted stream 32. The resulting stream (lean stream and second portion) having parameters as at point 10 enters heat exchanger HE-3 where it is cooled, while heating working stream 15-16, to a point having parameters as at point 11. The stream having parameters as at point 11 is then throttled to the pressure of point 34, obtaining parameters as at point 12.

Returning to turbine T, not all of the turbine inflow was extracted at point 32 in a partially expanded state. The remainder, referred to as the first portion, is expanded to a suitably chosen low pressure and exits the turbine T at point 34. The cycle is closed.

Figure 2:
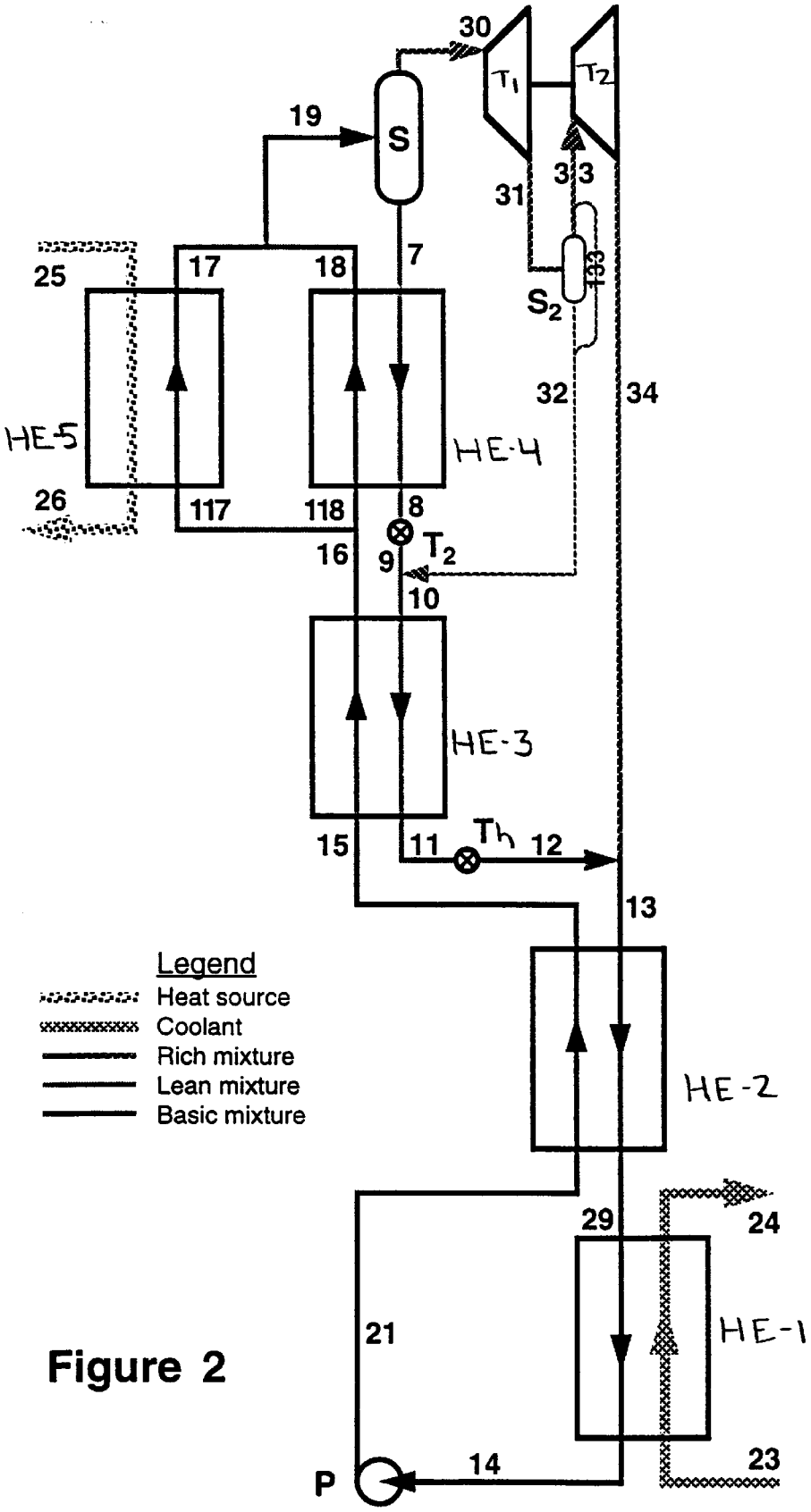
FIG. 2 is a diagram of another embodiment of the FIG. 1 system which permits an extracted stream and a completely spent stream to have compositions which are different from the high pressure charged stream.

In the embodiment shown in FIG. 1, the extraction at point 32 has the same composition as the streams at points 30 and 34. In the embodiment shown in FIG. 2, the turbine is shown as first turbine stage T-1 and second turbine stage T-2, with the partially expanded rich stream leaving the higher pressure stage T-1 of the turbine at point 31. Conditions at the numbered points shown on FIG. 2 are presented in Table 2. A typical output from the FIG. 2 system is presented in Table 6.

Referring to FIG. 2, the partially expanded rich stream from first turbine stage T-1 is divided into a first portion at 33 that is expanded further at lower pressure turbine stage T-2, and a second portion at 32 that is combined with the lean stream at 9. The partially expanded rich stream enters separator S-2, where it is separated into a vapor portion and a liquid portion. The composition of the second portion at 32 may be chosen in order to optimize its effectiveness when it is mixed with the stream at point 9. Separator S-2 permits stream 32 to be as lean as the saturated liquid at the pressure and temperature obtained in the separator S-2; in that case, stream 33 would be a saturated vapor at the conditions obtained in the separator S-2. By choice of the amount of mixing at stream 133, the amount of saturated liquid and the saturated vapor in stream 32 can be varied.

Figure 3:
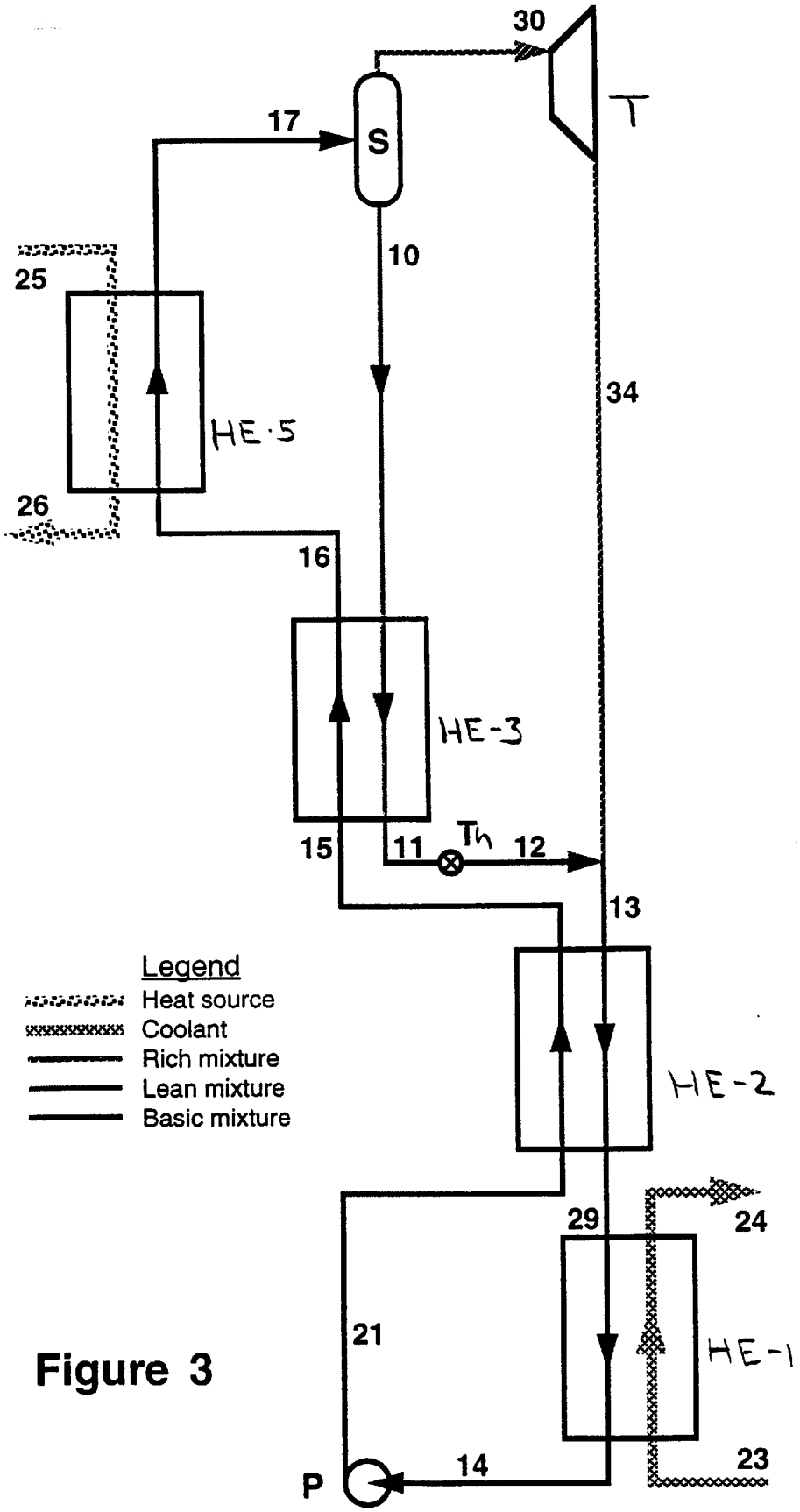
FIG. 3 is a diagram of a simplified embodiment in which there is no extracted stream.

Referring to FIG. 3, this embodiment differs from the embodiment of FIG. 1, in that the heat exchanger HE-4 has been omitted, and there is no extraction of a partially expanded stream from the turbine stage. In the FIG. 3 embodiment, the hot stream exiting the separator S is admitted directly into heat exchanger HE-3. Conditions at the numbered points shown on FIG. 3 are presented in Table 3. A typical output from the system is presented in Table 7.

Figure 4:
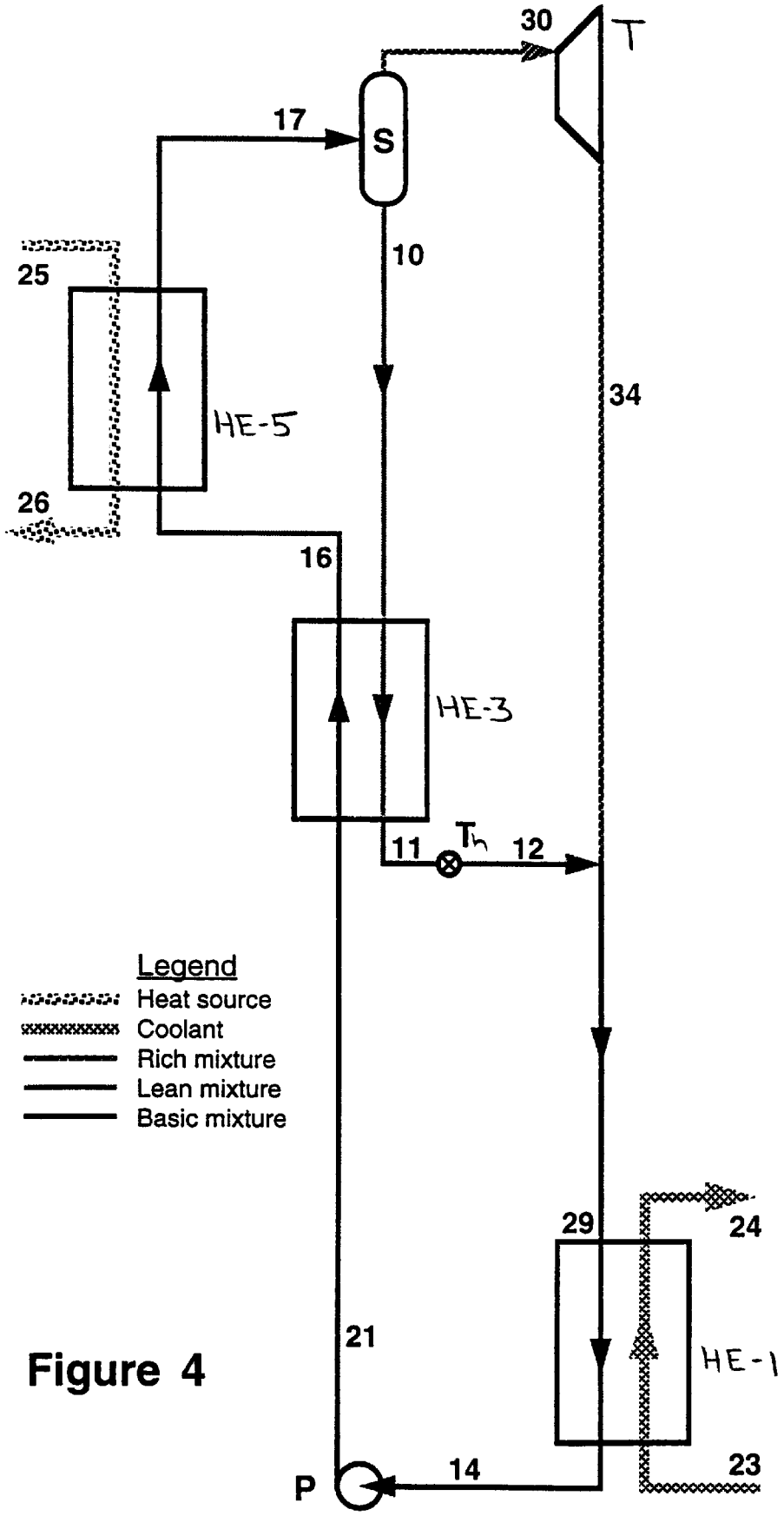
FIG. 4 is a diagram of a further simplified embodiment.

Referring to FIG. 4, this embodiment differs from the FIG. 3 embodiment in omitting heat exchanger HE-2. Conditions at the numbered points shown on FIG. 4 are presented in Table 4. A typical output from the system is presented in Table 8. While omitting heat exchanger HE-2 reduces the efficiency of the process, it may be economically advisable in circumstances where the increased power given up will not pay for the cost of the heat exchanger.

In general, standard equipment may be utilized in carrying out the method of this invention. Thus, equipment such as heat exchangers, tanks, pumps, turbines, valves and fittings of the type used in a typical Rankine cycles, may be employed in carrying out the method of this invention.

In the described embodiments of the invention, the working fluid is expanded to drive a turbine of conventional type. However, the expansion of the working fluid from a charged high pressure level to a spent low pressure level to release energy may be effected by any suitable conventional means known to those skilled in the art. The energy so released may be stored or utilized in accordance with any of a number of conventional methods known to those skilled in the art.

The separators of the described embodiments can be conventionally used gravity separators, such as conventional flash tanks. Any conventional apparatus used to form two or more streams having different compositions from a single stream may be used to form the lean stream and the enriched stream from the fluid working stream.

The condenser may be any type of known heat rejection device. For example, the condenser may take the form of a heat exchanger, such as a water cooled system, or another type of condensing device.

Various types of heat sources may be used to drive the cycle of this invention.

TABLE 1

| # | P psiA | X | T ° F. | H BTU/lb | G/G30 | Flow lb/hr | Phase |
|---|---|---|---|---|---|---|---|
| 7 | 325.22 | .5156 | 202.81 | 82.29 | .5978 | 276,778 | SatLiquid |
| 8 | 305.22 | .5156 | 169.52 | 44.55 | .5978 | 276,778 | Liq 28° |
| 9 | 214.26 | .5156 | 169.50 | 44.55 | .5978 | 276,778 | Wet .9997 |
| 10 | 214.26 | .5533 | 169.52 | 90.30 | .6513 | 301,549 | Wet .9191 |
| 11 | 194.26 | .5533 | 99.83 | −29.79 | .6513 | 301,549 | Liq 53° |
| 12 | 85.43 | .5533 | 99.36 | −29.79 | .6513 | 301,549 | Wet .9987 |
| 13 | 85.43 | .7000 | 99.83 | 174.41 | 1 | 463,016 | Wet .6651 |
| 14 | 84.43 | .7000 | 72.40 | −38.12 | 1 | 463,016 | SatLiquid |
| 15 | 350.22 | .7000 | 94.83 | −13.08 | 1 | 463,016 | Liq 73° |
| 16 | 335.22 | .7000 | 164.52 | 65.13 | 1 | 463,016 | SatLiquid |
| 117 | 335.22 | .7000 | 164.52 | 65.13 | .8955 | 463,016 | SatLiquid |
| 17 | 325.22 | .7000 | 203.40 | 302.92 | .8955 | 414,621 | Wet .5946 |
| 118 | 335.22 | .7000 | 164.52 | 65.13 | .1045 | 463,016 | SatLiquid |
| 18 | 325.22 | .7000 | 197.81 | 281.00 | .1045 | 48,395 | Wet .6254 |
| 19 | 325.22 | .7000 | 202.81 | 300.63 | 1 | 463,016 | Wet .5978 |
| 21 | 355.22 | .7000 | 73.16 | −36.76 | 1 | 463,016 | Liq 96° |
| 29 | 84.93 | .7000 | 95.02 | 150.73 | 1 | 463,016 | Wet .6984 |
| 30 | 325.22 | .9740 | 202.81 | 625.10 | .4022 | 186,238 | SatVapor |
| 32 | 214.26 | .9740 | 170.19 | 601.53 | .0535 | 24,771 | Wet .0194 |
| 34 | 85.43 | .9740 | 104.60 | 555.75 | .3487 | 161,467 | Wet .0467 |
| 23 | . | Water | 64.40 | 32.40 | 9.8669 | 4,568,519 | |
| 24 | . | Water | 83.54 | 51.54 | 9.8669 | 4,568,519 | |
| 25 | . | Water | 208.40 | 176.40 | 5.4766 | 2,535,750 | |
| 26 | . | Water | 169.52 | 137.52 | 5.4766 | 2,535,750 | |

TABLE 2

| # | P psiA | X | T ° F. | H BTU/lb | G/G30 | Flow lb/hr | Phase |
|---|---|---|---|---|---|---|---|
| 7 | 325.22 | .5156 | 202.81 | 82.29 | .5978 | 276,778 | SatLiquid |
| 8 | 305.22 | .5156 | 169.52 | 44.55 | .5978 | 276,778 | Liq 28° |
| 9 | 214.19 | .5156 | 169.48 | 44.55 | .5978 | 276,778 | Wet .9997 |
| 10 | 214.19 | .5523 | 169.52 | 89.23 | .6570 | 304,216 | Wet .921 |
| 11 | 194.19 | .5523 | 99.74 | −29.96 | .6570 | 304,216 | Liq 53° |
| 12 | 85.43 | .5523 | 99.53 | −29.96 | .6570 | 304,216 | Wet .9992 |
| 13 | 85.43 | .7000 | 99.74 | 173.96 | 1 | 463,016 | Wet .6658 |
| 14 | 84.43 | .7000 | 72.40 | −38.12 | 1 | 463,016 | SatLiquid |
| 15 | 350.22 | .7000 | 94.74 | −13.18 | 1 | 463,016 | Liq 73° |
| 16 | 335.22 | .7000 | 164.52 | 65.13 | 1 | 463,016 | SatLiquid |
| 117 | 335.22 | .7000 | 164.52 | 65.13 | .8955 | 463,016 | SatLiquid |
| 17 | 325.22 | .7000 | 203.40 | 302.92 | .8955 | 414,621 | Wet .5946 |
| 118 | 335.22 | .7000 | 164.52 | 65.13 | .1045 | 463,016 | SatLiquid |
| 18 | 325.22 | .7000 | 197.81 | 281.00 | .1045 | 48,395 | Wet .6254 |
| 19 | 325.22 | .7000 | 202.81 | 300.63 | 1 | 463,016 | Wet .5978 |
| 21 | 355.22 | .7000 | 73.16 | −36.76 | 1 | 463,016 | Liq 96° |
| 29 | 84.93 | .7000 | 94.96 | 150.38 | 1 | 463,016 | Wet .6989 |
| 30 | 325.22 | .9740 | 202.81 | 625.10 | .4022 | 186,238 | SatVapor |
| 31 | 214.69 | .9740 | 170.63 | 602.12 | .4022 | 186,238 | Wet. 0189 |
| 32 | 214.26 | .9224 | 170.63 | 539.93 | .0593 | 27,437 | Wet .1285 |
| 33 | 214.69 | .9828 | 170.63 | 612.87 | .3430 | 158,800 | SatVapor |
| 34 | 85.43 | .9829 | 102.18 | 564.60 | .3430 | 158,800 | Wet .0294 |
| 35 | 214.69 | .5119 | 170.63 | 45.44 | .0076 | 3,527 | SatLiquid |
| 23 | . | Water | 64.40 | 32.40 | 9.8666 | 4,568,371 | |
| 24 | . | Water | 83.50 | 51.50 | 9.8666 | 4,568,371 | |
| 25 | . | Water | 208.40 | 176.40 | 5.4766 | 2,535,750 | |
| 26 | . | Water | 169.52 | 137.52 | 5.4766 | 2,535,750 | |

TABLE 3

| # | P psiA | X | T ° F. | H BTU/lb | G/G30 | Flow lb/hr | Phase |
|---|---|---|---|---|---|---|---|
| 10 | 291.89 | .4826 | 203.40 | 80.72 | .6506 | 294,484 | SatLiquid |
| 11 | 271.89 | .4826 | 109.02 | −23.56 | .6506 | 294,484 | Liq 89° |
| 12 | 75.35 | .4826 | 109.07 | −23.56 | .6506 | 294,484 | Wet .9994 |
| 13 | 75.35 | .6527 | 109.02 | 180.50 | 1 | 452,648 | Wet .6669 |
| 14 | 74.35 | .6527 | 72.40 | −47.40 | 1 | 452,648 | SatLiquid |

TABLE 3-continued

| # | P psiA | X | T ° F. | H BTU/lb | G/G30 | Flow lb/hr | Phase |
|---|---|---|---|---|---|---|---|
| 15 | 316.89 | .6527 | 103.99 | −12.43 | 1 | 452,648 | Liq 64° |
| 16 | 301.89 | .6527 | 164.52 | 55.41 | 1 | 452,648 | SatLiquid |
| 17 | 291.89 | .6527 | 203.40 | 273.22 | 1 | 452,648 | Wet .6506 |
| 21 | 321.89 | .6527 | 73.04 | −46.18 | 1 | 452,648 | Liq 97° |
| 29 | 74.85 | .6527 | 100.84 | 146.74 | 1 | 452,648 | Wet .7104 |
| 30 | 291.89 | .9693 | 203.40 | 631.64 | .3494 | 158,164 | SatVapor |
| 34 | 75.35 | .9693 | 108.59 | 560.44 | .3494 | 158,164 | Wet .0474 |
| 23 | . | Water | 64.40 | 32.40 | 8.1318 | 3,680,852 | |
| 24 | . | Water | 88.27 | 56.27 | 8.1318 | 3,680,852 | |
| 25 | . | Water | 208.40 | 176.40 | 5.6020 | 2,535,750 | |
| 26 | . | Water | 169.52 | 137.52 | 5.6020 | 2,535,750 | |

TABLE 4

| # | P psiA | X | T ° F. | H BTU/lb | G/G30 | Flow lb/hr | Phase |
|---|---|---|---|---|---|---|---|
| 10 | 214.30 | .4059 | 203.40 | 80.05 | .7420 | 395,533 | SatLiquid |
| 11 | 194.30 | .4059 | 77.86 | −55.30 | .7420 | 395,533 | Liq 118° |
| 12 | 52.48 | .4059 | 78.17 | −55.30 | .7420 | 395,533 | Liq 32° |
| 29 | 52.48 | .5480 | 104.46 | 106.44 | 1 | 533,080 | Wet .7825 |
| 14 | 51.98 | .5480 | 72.40 | −60.06 | 1 | 533,080 | SatLiquid |
| 21 | 244.30 | .5480 | 72.83 | −59.16 | 1 | 533,080 | Liq 98° |
| 16 | 224.30 | .5480 | 164.52 | 41.26 | 1 | 533,080 | SatLiquid |
| 17 | 214.30 | .5480 | 203.40 | 226.20 | 1 | 533,080 | Wet .742 |
| 30 | 214.30 | .9767 | 203.40 | 646.49 | .2580 | 137,546 | SatVapor |
| 34 | 52.48 | .9767 | 114.19 | 571.55 | .2580 | 137,546 | Wet .0473 |
| 23 | . | Water | 64.40 | 32.40 | 5.7346 | 3,057,018 | |
| 24 | . | Water | 93.43 | 61.43 | 5.7346 | 3,057,018 | |
| 25 | . | Water | 208.40 | 176.40 | 4.7568 | 2,535,750 | |
| 26 | . | Water | 169.25 | 137.52 | 4.7568 | 2,535,750 | |

TABLE 5

| Performance Summary KCS34 Case 1 | | |
|---|---|---|
| Heat in | 28893.87 kW | 237.78 BTU/lb |
| Heat rejected | 25638.63 kW | 210.99 BTU/lb |
| Σ Turbine enthalpy drops | 3420.86 kW | 28.15 BTU/lb |
| Turbine Work | 3184.82 kW | 26.21 BTU/lb |
| Feed pump ΔH 1.36, power | 175.97 kW | 1.45 BTU/lb |
| Feed + Coolant pump power | 364.36 kW | 3.00 BTU/lb |
| Net Work | 2820.46 kW | 23.21 BTU/lb |
| Gross Output | 3184.82 kWe | |
| Cycle Output | 3008.85 kWe | |
| Net Output | 2820.46 kWe | |
| Net thermal efficiency | 9.76% | |
| Second law limit | 17.56% | |
| Second law efficiency | 55.58% | |
| Specific Brine Consumption | 899.05 lb/kW hr | |
| Specific Power Output | 1.11 Watt hr/lb | |

TABLE 6

| Performance Summary KCS34 Case 2 | | |
|---|---|---|
| Turbine mass flow | 58.34 kg/s | 463016 lb/hr |
| Pt 30 Volume flow | 4044.45 1/s | 514182 ft^3/hr |
| Heat in | 28893.87 kW | 212.93 BTU/lb |
| Heat rejected | 25578.48 kW | 188.50 BTU/lb |
| Σ Turbine enthalpy drops | 3500.33 kW | 25.80 BTU/lb |
| Turbine Work | 3258.81 kW | 24.02 BTU/lb |
| Feed pump ΔH 1.36, power | 196.51 kW | 1.45 BTU/lb |
| Feed + Coolant pump power | 408.52 kW | 3.01 BTU/lb |
| Net Work | 2850.29 kW | 21.00 BTU/lb |
| Gross Output | 3258.81 kWe | |
| Cycle Output | 3062.30 kWe | |

TABLE 6-continued

| Performance Summary KCS34 Case 2 | |
|---|---|
| Net Output | 2850.29 kWe |
| Net thermal efficiency | 9.86% |
| Second law limit | 17.74% |
| Second law efficiency | 55.60% |
| Specific Brine Consumption | 889.65 lb/kW hr |
| Specific Power Output | 1.12 Watt hr/lb |

TABLE 7

| Performance Summary KCS34 Case 3 | | |
|---|---|---|
| Turbine mass flow | 57.03 kg/s | 452648 lb/hr |
| Pt 30 Volume flow | 4474.71 l/s | 568882 ft^3/hr |
| Heat in | 28893.87 kW | 217.81 BTU/lb |
| Heat rejected | 25754.18 kW | 194.14 BTU/lb |
| Σ Turbine enthalpy drops | 3300.55 kW | 24.88 BTU/lb |
| Turbine Work | 3072.82 kW | 23.16 BTU/lb |
| Feed pump ΔH 1.21, power | 170.92 kW | 1.29 BTU/lb |
| Feed + Coolant pump power | 341.75 kW | 2.58 BTU/lb |
| Net Work | 2731.07 kW | 20.59 BTU/lb |
| Gross Output | 3072.82 kWe | |
| Cycle Output | 2901.89 kWe | |
| Net Output | 2731.07 kWe | |
| Net thermal efficiency | 9.45% | |
| Second law limit | 17.39% | |
| Second law efficiency | 54.34% | |
| Specific Brine Consumption | 928.48 lb/kW hr | |
| Specific Power Output | 1.08 Watt hr/lb | |
| Heat to Steam Boiler | 15851.00 kW | 577.22 BTU/lb |
| Heat Rejected | 10736.96 kW | 390.99 BTU/lb |

TABLE 8

| Performance Summary KCS34 Case 4 | | |
|---|---|---|
| Turbine mass flow | 67.17 kg/s | 533080 lb/hr |
| Pt 30 Volume flow | 7407.64 1/s | 941754 ft^3/hr |
| Heat in | 28893.87 kW | 184.94 BTU/lb |
| Heat rejected | 26012.25 kW | 166.50 BTU/lb |
| Σ Turbine enthalpy drops | 3020.89 kW | 19.34 BTU/lb |
| Turbine Work | 2812.45 kW | 18.00 BTU/lb |
| Feed pump ΔH .89, power | 147.99 kW | 0.95 BTU/lb |
| Feed + Coolant pump power | 289.86 kW | 1.86 BTU/lb |
| Net Work | 2522.59 kW | 16.15 BTU/lb |
| Gross Output | 2812.45 kWe | |
| Cycle Output | 2664.46 kWe | |
| Net Output | 2522.59 kWe | |
| Net thermal efficiency | 8.73% | |
| Second law limit | 17.02% | |
| Second law efficiency | 51.29% | |
| Specific Brine Consumption | 1005.22 lb/kW hr | |
| Specific Power Output | 0.99 Watt hr/lb | |

What is claimed is:

1. A method for implementing a thermodynamic cycle comprising heating a working stream including a low boiling point component and a higher boiling point component with a source of external heat to provide a heated gaseous working stream, separating said heated gaseous working stream at a first separator to provide a heated gaseous rich stream having relatively more of said low boiling point component and a lean stream having relatively less of said low boiling point component, expanding said heated gaseous rich stream to transform the energy of the stream into useable form and to provide an expanded, spent rich stream, and combining said lean stream and said expanded, spent rich stream to provide said working stream, wherein, after said combining and before said heating with said external source of heat, said working stream is condensed by transferring heat to a low temperature source at a first heat exchanger, and said working stream is thereafter pumped to a higher pressure, and further comprising transferring, at a second heat exchanger, heat from said working stream, prior to said working stream being condensed, to said working stream after said working stream has been pumped to said higher pressure and prior to said heating with said external source of heat.

2. The method of claim 1 wherein said expanding takes place in a first expansion step and a second expansion step, said heated gaseous rich stream being partially expanded to provide a partially expanded rich stream in said first expansion step, further comprising dividing said partially expanded rich stream into a first portion and a second portion, wherein said first portion is expanded to provide said expanded, spent rich stream in said second expansion step, and further comprising combining said second portion with said lean stream before said combining of said lean stream and said expanded, spent rich stream.

3. The method of claim 1 further comprising transferring, at a third heat exchanger, heat from said lean stream to said working stream after said working stream has received heat at said second heat exchanger and prior to said heating with said external source of heat.

4. A method for implementing a thermodynamic cycle comprising heating a working stream including a low boiling point component and a higher boiling point component with a source of external heat to provide a heated gaseous working stream, separating said heated gaseous working stream at a first separator to provide a heated gaseous rich stream having relatively more of said low boiling point component and a lean stream having relatively less of said low boiling point component, expanding said heated gaseous rich stream to transform the energy of the stream into useable form and to provide an expanded, spent rich stream, and combining said lean stream and said expanded, spent rich stream to provide said working stream, wherein, after said combining and before said heating with said external source of heat, said working stream is condensed by transferring heat to a low temperature source at a first heat exchanger, and said working stream is thereafter pumped to a higher pressure, and further comprising splitting said working stream, after said pumping and prior to said heating with said external source of heat, into a first working substream and a second working substream, and wherein said heating with said external source of heat involves heating said first working substream with said external source of heat to provide a heated first working substream and thereafter combining said heated first working substream with said second working substream to provide said heated gaseous working stream.

5. The method of claim 4 further comprising transferring, at a fourth heat exchanger, heat from said lean stream to said second working substream.

6. The method of claim 1 wherein said heating with said external source of heat occurs at a fifth heat exchanger.

7. The method of claim 2 wherein said dividing includes separating said partially expanded rich stream into a vapor portion and a liquid portion, said first portion including at least some of said vapor portion, and said second portion including said liquid portion.

8. The method of claim 7 further comprising combining some of said vapor portion with said liquid portion to provide said second portion.

9. The method of claim 6 further comprising transferring, at a heat exchanger, heat from said lean stream with said second portion to said working stream before said working stream has been heated with said external source of heat.

10. Apparatus for implementing a thermodynamic cycle comprising a heater that heats a working stream including a low boiling point component and a higher boiling point component with a source of external heat to provide a heated gaseous working stream, a first separator connected to receive said heated gaseous working stream and to output a heated gaseous rich stream having relatively more of said low boiling point component and a lean stream having relatively less of said low boiling point component, an expander that is connected to receive said heated gaseous rich stream and transform the energy of the stream into useable form and to output an expanded, spent rich stream, and a first stream mixer that is connected to combine said lean stream and said expanded, spent rich stream and output said working stream, the output of said stream mixer being connected to the input to said heater, further comprising a first heat exchanger and a pump that are connected between said first stream mixer and said heater, said first heat exchanger condensing said working stream by transferring heat to a low temperature source, and said pump thereafter pumping said working stream to a higher pressure, and further comprising a second heat exchanger connected to transfer heat from said working stream, prior to said working stream being condensed, to said working stream after said working stream has been pumped to said higher pressure at said pump and prior to said heating with said external source of heat at said heater.

11. The apparatus of claim 10 wherein said expander includes a first expansion stage and a second expansion stage, said first expansion stage being connected to receive said heated gaseous rich stream and to output a partially expanded rich stream, further comprising a stream divider that is connected to receive said partially expanded rich stream and divide it into a first portion and a second portion, wherein said second stage is connected to receive said first portion and expands said first portion to provide said expanded, spent rich stream, and further comprising a second stream mixer that is connected to combine said second portion with said lean stream before said lean stream is combined with said expanded, spent rich stream at said first stream mixer.

12. The apparatus of claim 10 further comprising a third heat exchanger connected to transfer heat from said lean stream to said working stream after said working stream has received heat at said second heat exchanger and prior to said heating with said external source of heat at said heater.

13. Apparatus for implementing a thermodynamic cycle comprising a heater that heats a working stream including a low boiling point component and a higher boiling point component with a source of external heat to provide a heated gaseous working stream, a first separator connected to receive said heated gaseous working stream and to output a heated gaseous rich stream having relatively more of said low boiling point component and a lean stream having relatively less of said low boiling point component, an expander that is connected to receive said heated gaseous rich stream and transform the energy of the stream into useable form and to output an expanded, spent rich stream, and a first stream mixer that is connected to combine said lean stream and said expanded, spent rich stream and output said working stream, the output of said stream mixer being connected to the input to said heater, further comprising a first heat exchanger and a pump that are connected between said first stream mixer and said heater, said first heat exchanger condensing said working stream by transferring heat to a low temperature source, and said pump thereafter pumping said working stream to a higher pressure, further comprising a stream splitter connected to split said working stream, after said pumping at said pump and prior to said heating with said external source of heat at said heater, into a first working substream and a second working substream, said heater heating said first working substream to provide a heated first working substream, and a third stream mixer connected to combine said heated first working substream with said second working substream to provide said heated gaseous working stream.

14. The apparatus of claim 13 further comprising a fourth heat exchanger connected to transfer heat from said lean stream to said second working substream.

15. The apparatus of claim 10 wherein said heater is a fifth heat exchanger.

16. The apparatus of claim 11 wherein said stream divider includes a second separator that is connected to receive said partially expanded rich stream and to separate it into a vapor portion and a liquid portion, said first portion including at least some of said vapor portion, and said second portion including said liquid portion.

17. The apparatus of claim 16 wherein said stream divider includes a fourth stream mixer connected to combine some of said vapor portion from said second separator with said liquid portion from said second separator to provide said second portion.

18. The apparatus of claim 11 further comprising a heat exchanger connected to transfer heat from said lean stream with said second portion to said working stream before said working stream has been heated with said external source of heat at said heater.

* * * * *